US005303281A

United States Patent [19]

Koller et al.

[11] Patent Number: 5,303,281

[45] Date of Patent: Apr. 12, 1994

[54] MAMMOGRAPHY METHOD AND IMPROVED MAMMOGRAPHY X-RAY TUBE

[75] Inventors: Thomas J. Koller; Robert C. Treseder, both of Salt Lake City, Utah

[73] Assignee: Varian Associates, Inc., Palo Alto, Calif.

[21] Appl. No.: 910,932

[22] Filed: Jul. 9, 1992

[51] Int. Cl.[5] ..... H01J 35/06

[52] U.S. Cl. ..... 378/134; 378/113; 378/136; 378/138

[58] Field of Search ..... 378/134, 136, 113, 138

[56] References Cited

U.S. PATENT DOCUMENTS

| | | | |
|---|---|---|---|
| 4,764,947 | 8/1988 | Lesensky | 378/138 |
| 4,823,371 | 4/1989 | Grady | 378/134 |
| 4,825,123 | 4/1989 | Franzel et al. | 378/136 |
| 4,866,749 | 9/1989 | Uematu | 378/134 |
| 4,868,842 | 9/1989 | Dowd | 378/138 |
| 4,894,853 | 1/1990 | Dowd | 378/138 |
| 5,031,200 | 7/1991 | Plessis et al. | 378/138 |
| 5,195,112 | 3/1993 | Vincent et al. | 378/134 |

FOREIGN PATENT DOCUMENTS 0283039 9/1988 European Pat. Off. .

*Primary Examiner*—David P. Porta
*Assistant Examiner*—Kim-Kwok Chu
*Attorney, Agent, or Firm*—Bella Fishman; Gerald M. Fisher

[57] ABSTRACT

A mammography X-ray tube providing increased X-ray intensity for shortening patient exposure times to eliminate motion artifacts. The cathode design permits superpositioning of electron beam from multiple filaments.

16 Claims, 5 Drawing Sheets

MAMMOGRAPHY METHOD AND IMPROVED MAMMOGRAPHY X-RAY TUBE

FIELD OF THE INVENTION

This invention relates to methods and apparatus for x-ray mammography diagnostics.

BACKGROUND OF THE INVENTION

Diagnostic X-ray equipment is well known for so called non-invasive examination. Equipment is available for industrial as well as medical applications. A most important element of such equipment is the generator of X-rays which is most typically a high vacuum tube with the capability of generating an electron beam and accelerating the beam toward a high speed rotating target where the impact produces X-rays which pass out of the vacuum envelope and are collimated and directed toward the patent or sample being studied. For standard X-ray diagnostic tubes, electric fields of 150 KV/inch to 300 KV/inch are employed which are produced in conjunction with DC voltages of 75 to 150 KV. Typically the distance between the cathode and the rotating target is on the order of 0.5 to 1 inch. It is known in such standard purpose X-ray tubes to superimpose electron beams produced from more than one filament onto the same focal spot on the anode target. In such standard purpose X-ray tubes this focussing is accomplished using a pair of cathode cups employing two and three slot designs. Typically, the slots have been machined grooves which form two cups which are symmetrically displaced about an axis. The cathode filaments are normally mounted adjacent the intersection of the smallest and next smallest slot. When the filament is mounted inside of the smallest slot, its emission is reduced because of space charge effects. The dimensions of the slots and the distance between the center of the slots to enable focusing of the beams from adjacent cups to a single spot has heretofore required at least 0.5 inch of anode to cathode spacing.

Mammography X-ray diagnostics is a special application for which a specific mammography X-ray tube has become standard. Specifically, the mammography tube is very much shorter in overall length than the standard X-ray tubes. The mammography tube is particularly designed to be able to have its X-ray exit port very close to the patient's breast to obtain the highest resolution and contrast picture possible.

Superimposition of electron beams from adjoining cathode cups has not been heretofore achieved in mammography X-ray tubes because the slot dimensions necessary in standard two slot cathode cup configurations required the center of the slots to be too far apart to allow the electron beams to become superimposed over the shorter anode to cathode distance employed in mammography tubes. For mammography tubes, the DC voltage employed is only 25 to 30 thousand volts. Because the shorter anode to cathode distances employed in these tubes, i.e. less than 0.3 inches, the fields are 110 KV/inch to 130 KV/inch.

In view of the above problems, currently designed mammography X-ray tubes are not capable of providing high intensity electron beams and are generally considered cathode emission limited. This requires the typical mammograph examination for large spot applications to take 1–2 seconds and for small spot, high resolution examinations to take approximately 5 seconds. The high resolution, 5 second examination time, introduces significant opportunity for picture blurring due to patient movement or other mechanical and environmental vibrations. Specifically, cathode filaments in mammography tubes with 0.1 mm focii typically could deliver only 25–30 ma and for a typical 0.3 mm focii could deliver only approximately 100 ma. Since the high voltage employed is 25 KV, the target anodes are not fully loaded. A three to four inch rotating anode can handle these power levels at 3000 RPM. Since the mammography X-ray tubes are capable of rotating their target anodes at speeds up to 9000 RPM, and the power handling capacity at this higher speed is 70% greater than at 3000 RPM, a technique to provide greater electron beam intensity can be accommodated by the existing mammography X-ray tube design by increasing the anode speed.

SUMMARY OF THE INVENTION

It is the object of this invention to enable shorter mammography patient exposure time and to avoid movement blurring effects.

It is a further object of this invention to provide a method and apparatus for increasing electron beam intensity in a mammography X-ray tube.

It is a feature of this invention to simultaneously excite a plurality of cathode filaments and to superimpose electron beams so formed on the same region of said X-ray tube rotating target anode.

It is a further feature of this invention that the cathode cups are formed in triple slot configurations.

DETAILED DESCRIPTION OF THE INVENTION

Figure 1:
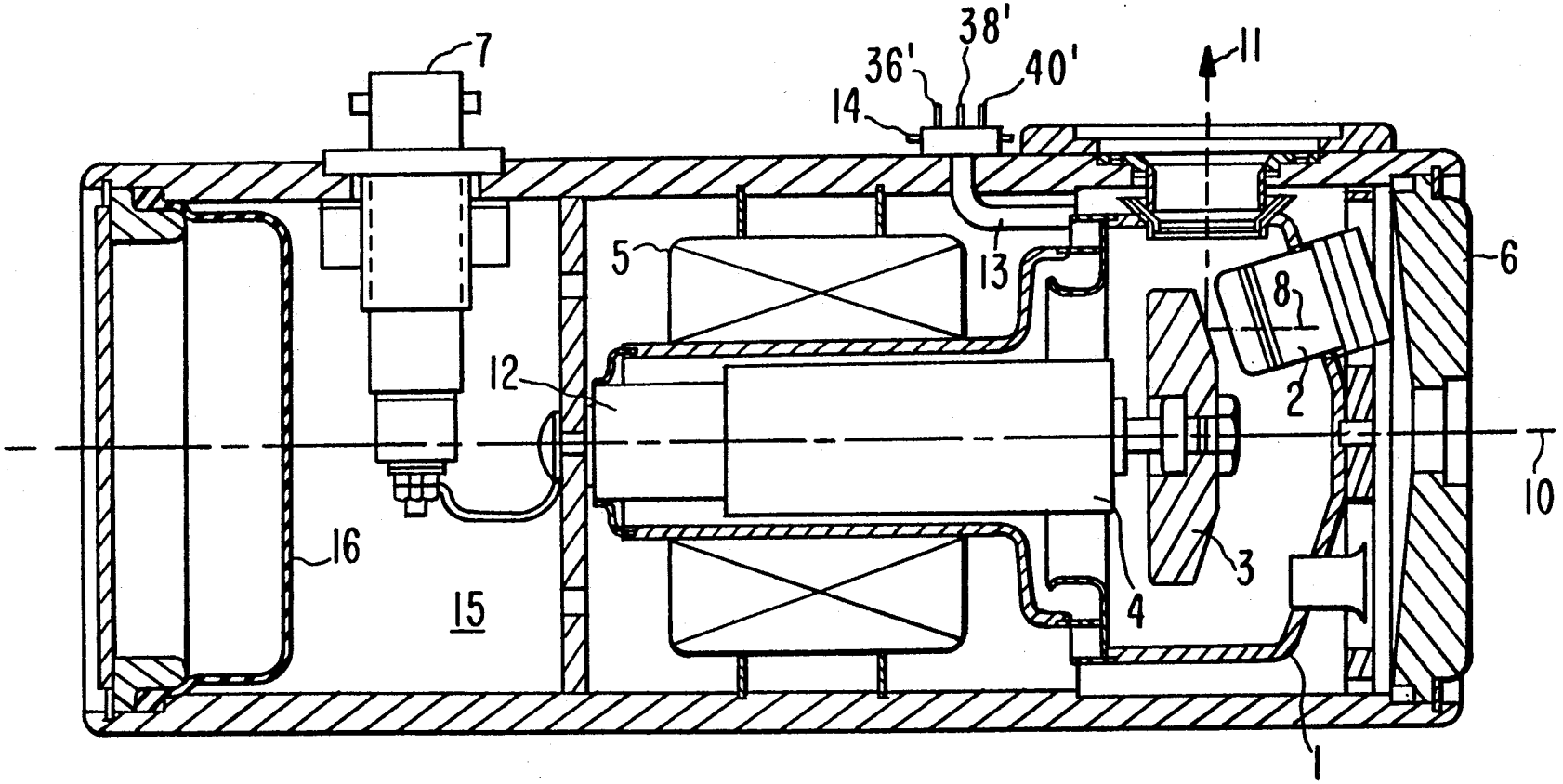
FIG. 1 PRIOR ART
FIG. 1 is a cross-section of a standard prior art mammography X-ray tube.

With reference to FIG. 1, the mammography X-ray tube has a vacuum envelope 1 containing a rotating anode 3, a motor rotor coil 4 for providing high speed drive power for said anode in conjunction with stator coils 5 of said motor. Cathode assembly 2 is offset from the axis 10 for providing a beam of electrons 8 which are accelerated to impact the sloped surface of the target anode in a fixed rectangle line in space which provides an output rectangular X-ray beam 11. The high voltage standoff 7 connects high voltage to the anode, i.e., 25 to 30 kv, through a bearing (not shown) between the rotor support 12 and the rotor 4 for coupling the high voltage to said rotating target 3 to create an accelerating field between the anode and cathode. Because the X-ray tube for mammography applications employs a lower energy X-ray, the accelerating voltage is considerably lower than in standard X-ray. The distance between the cathode assembly and the target in such mammography tubes is less than 0.3 inches. The cathode assembly 2 filament current is supplied to the cathode assembly from connector 14 via conductors 13. One side of each filament is normally grounded to the housing. Space 15 on the inside of the housing which is not within the vacuum envelope is filled with a dielectric oil. The elastomeric cup 16 is able to deform to accommodate temperature induced changes in the oil and to maintain oil pressure.

Figure 2:
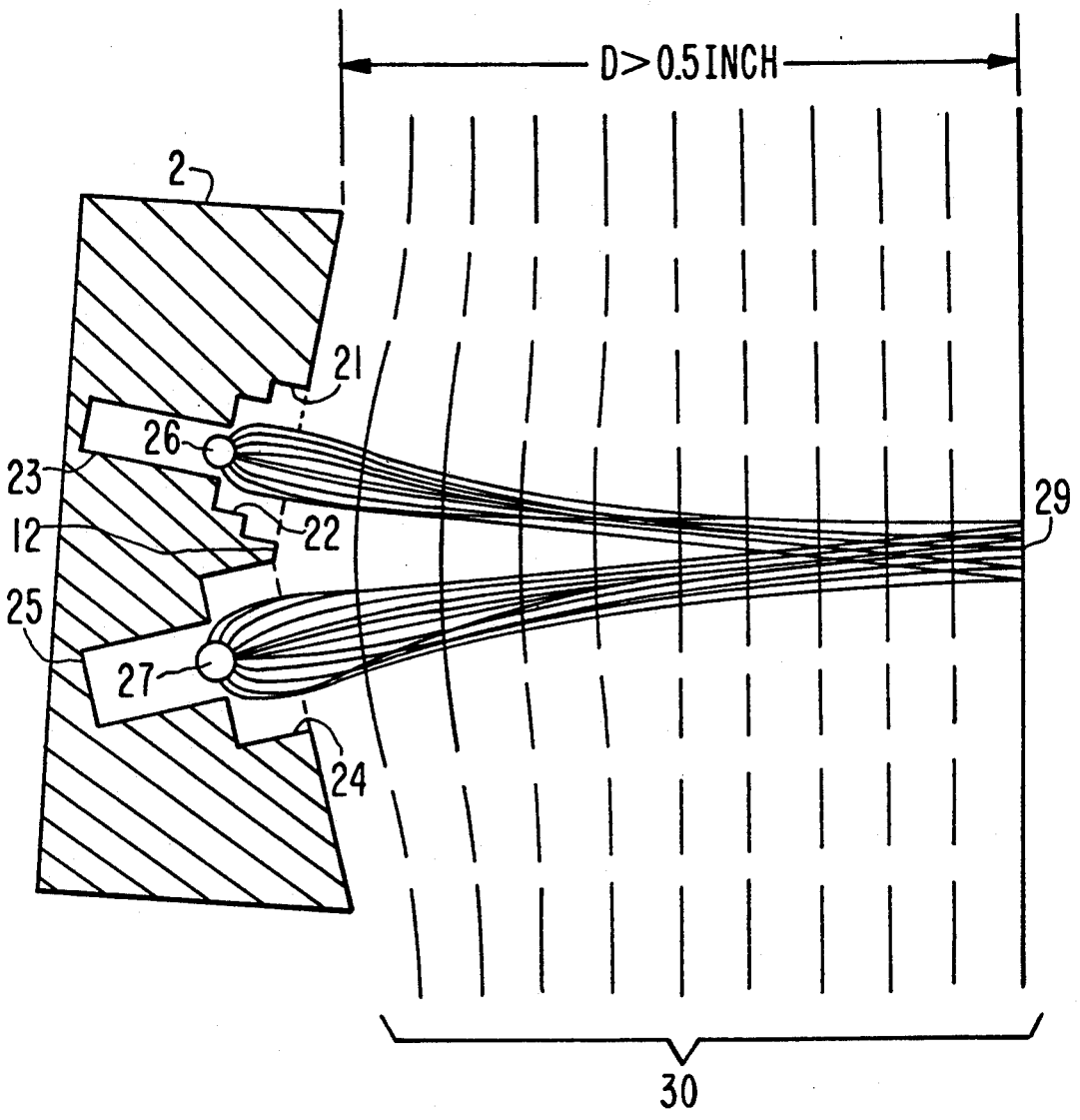
FIG. 2 PRIOR ART
FIG. 2 is a schematic of electron optics for superimposing small filament and large filament beams for a standard diagnostic X-ray tube having anode to cathode distances greater than 0.5 inch.

In the prior art standard X-ray tube, the distance between the cathode assembly 2 and the target is long enough, as shown in FIG. 2, i.e. $D>0.5$ inch, in cooperation with the higher electric field gradient and the double slot and triple slot cathode cups to superimpose the beams from the small filament 26 and the large filament 27 to a single region 29 on the target anode. In the prior art standard X-ray tube, the two filaments are not excited simultaneously but rather they provide the ability to select a high or a low resolution focused X-ray beam which will exist the X-ray tube on exactly the same center line. As indicated in FIG. 2, a symmetrical triple slot 21, 22 and 23 filament cup configuration for the smaller diameter filament is coupled together with a symmetrical double slotted 24 and 25 filament cup configuration for the larger diameter helix filament 27. Note that the prior art cups are each completely symmetrical and separated somewhat, 12 at their closest contact.

In contrast, the Mammography X-ray tubes have not been able to superimpose both the large and small filaments using the double and triple slot design because the distance D is smaller and the field gradient is lower. Electron optics computer modeling is not successful to provide adequate calculations to solve this problem in the X-ray tube because the helical cathode filaments do not emit electrons either uniformly in energy or direction. Accordingly, we have empirically discovered a technique that makes it possible to focus different size beams as well as equal size beams to superimpose beams on the same region of the anode of a mammography X-ray tube.

Figure 3A:
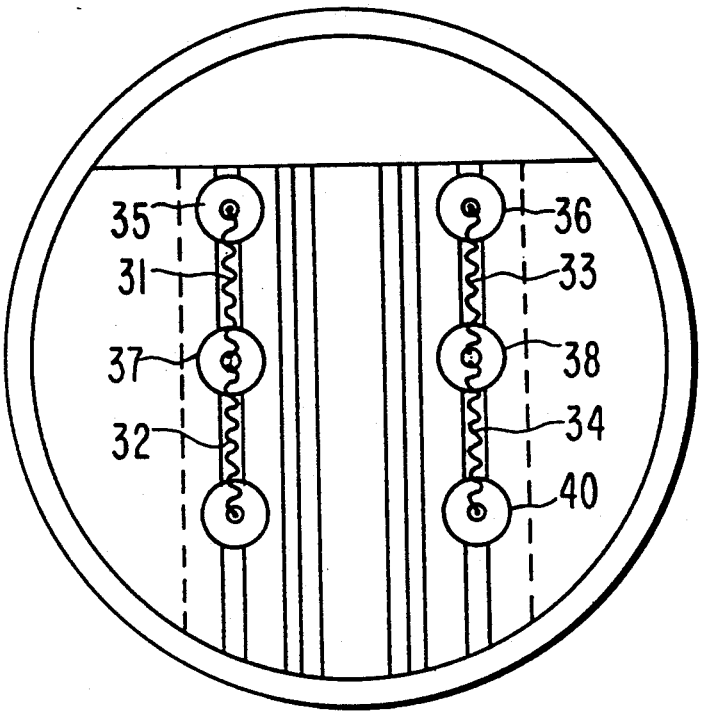
FIG. 3A is the front view of a preferred cathode assembly of our invention.
Figure 3C:
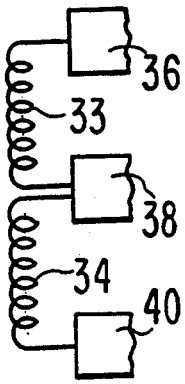
FIG. 3C is a schematic of filament connections of the cathode assembly of FIG. 3A.
Figure 3B:
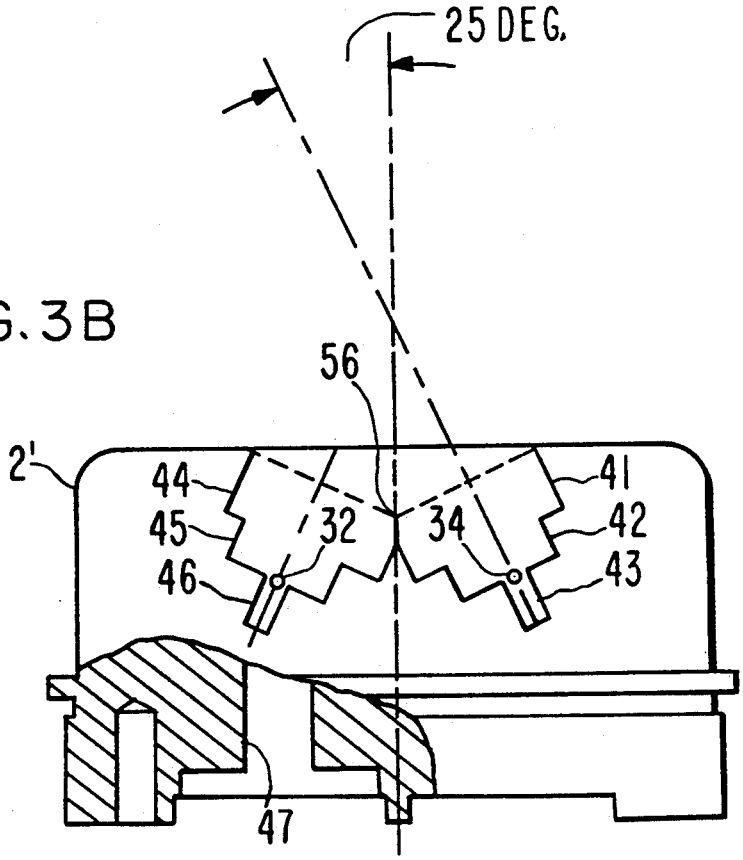
FIG. 3B is a side view of Section A—A of FIG. 3A.

With reference to FIG. 3A and FIG. 3B is disclosed a novel cathode assembly for use with a mammography X-ray tube which enables superposition of a plurality of electron beams on a common anode region. The novel cathode assembly, with reference to FIG. 3B, comprises a first triple slot 44, 45 and 46 filament cup which intersects a second triple slot 41, 42 and 43 filament cup. Neither cup is symmetrical since the intersection of the two cups along line 56 interrupts the slots 44 and 41. Slots 45 and 46 are parallelepiped shaped with rectangular cross sections, and slots 41 and 44 are prismoids with trapezoid cross section.

In the preferred embodiments of FIG. 3A, 3B and 3C, matching filament 32 and 34 are mounted is slots 46 and 43 respectively and are matching in diameter and all other characteristics. As shown, in FIG. 3C, there are two filaments in each slot. In slot 43, filaments 34 is the large diameter filament and filament 33 is a small diameter filament. In slot 46, as stated, filament 32 is a large diameter filament matching filament 34 and filament 31 is a smaller diameter filament matching the smaller diameter filament 33.

Filaments 34 and 32 are connected electrically in parallel by connecting terminals 40 and 39 together. Terminals 37 and 38 are common and are also connected together. Filaments 31 and 33 are also connected electrically in parallel by connecting terminals 36 and 35 together.

External controls connected via connector 7 enables the selection of the pair of larger diameter filaments or the pair of small diameter filaments to be simultaneously excited to create electron beams which are superimposed.

The two larger diameter beams will superimpose at a first focal rectangle and the two smaller diameter beams will superimpose at a second displaced focal rectangle.

By combining via superposition the electron beams from two filaments simultaneously, we are able to essentially double the beam current and substantially increase the X-ray intensity in both the small spot 0.1 mm focii and in the larger 0.3 mm focii mode. This substantially reduces the amount of exposure time required for a picture which greatly enhances the ability to avoid motion artifacts.

Figure 4:
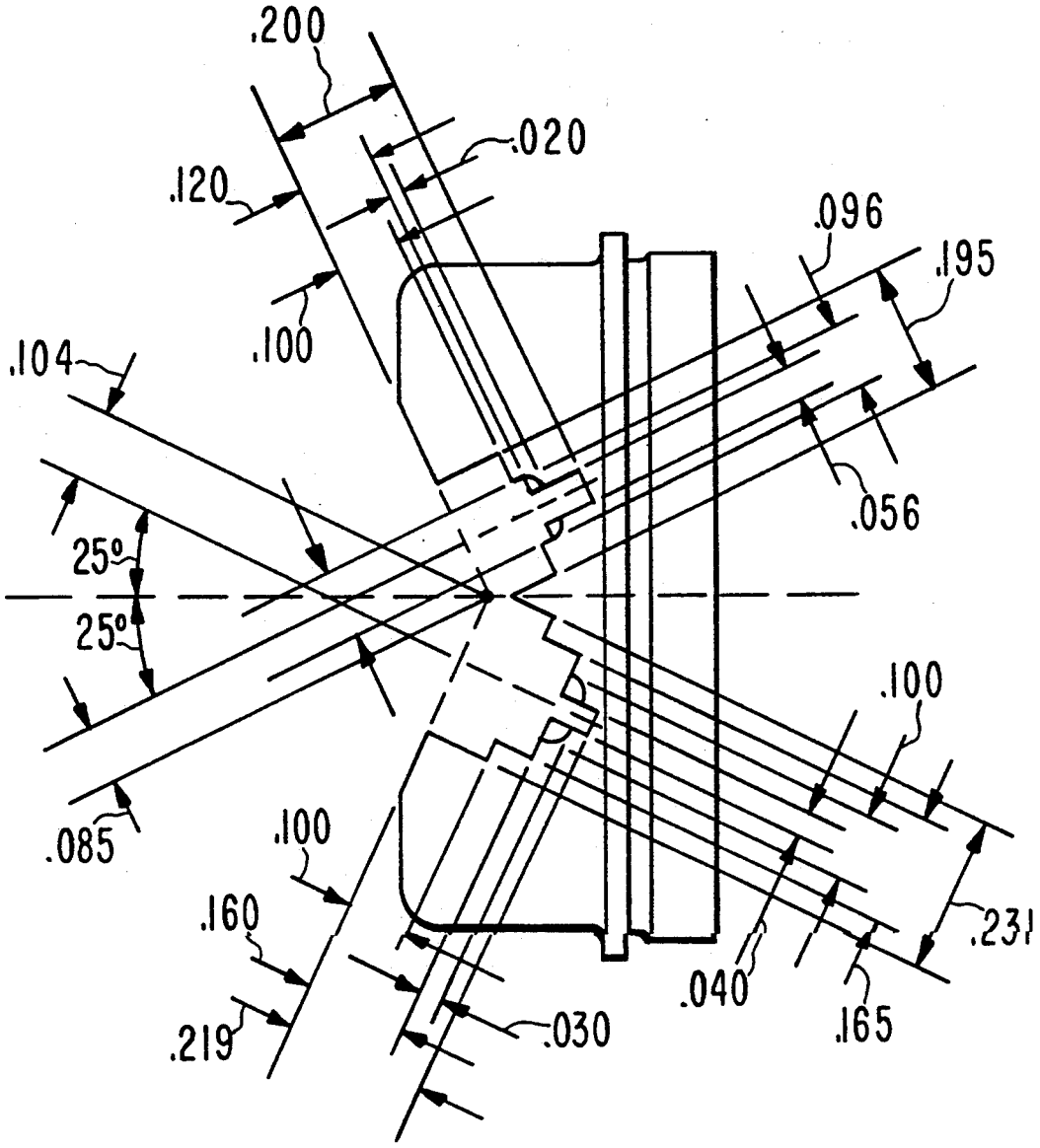
FIG. 4 is the preferred cathode assembly of FIG. 3A showing its detailed dimensions.

FIG. 4 gives the exact dimensions of the preferred cathode cup configuration for use with the Varian mammography X-ray tube Model M143-SP according to this invention.

Figure 5:
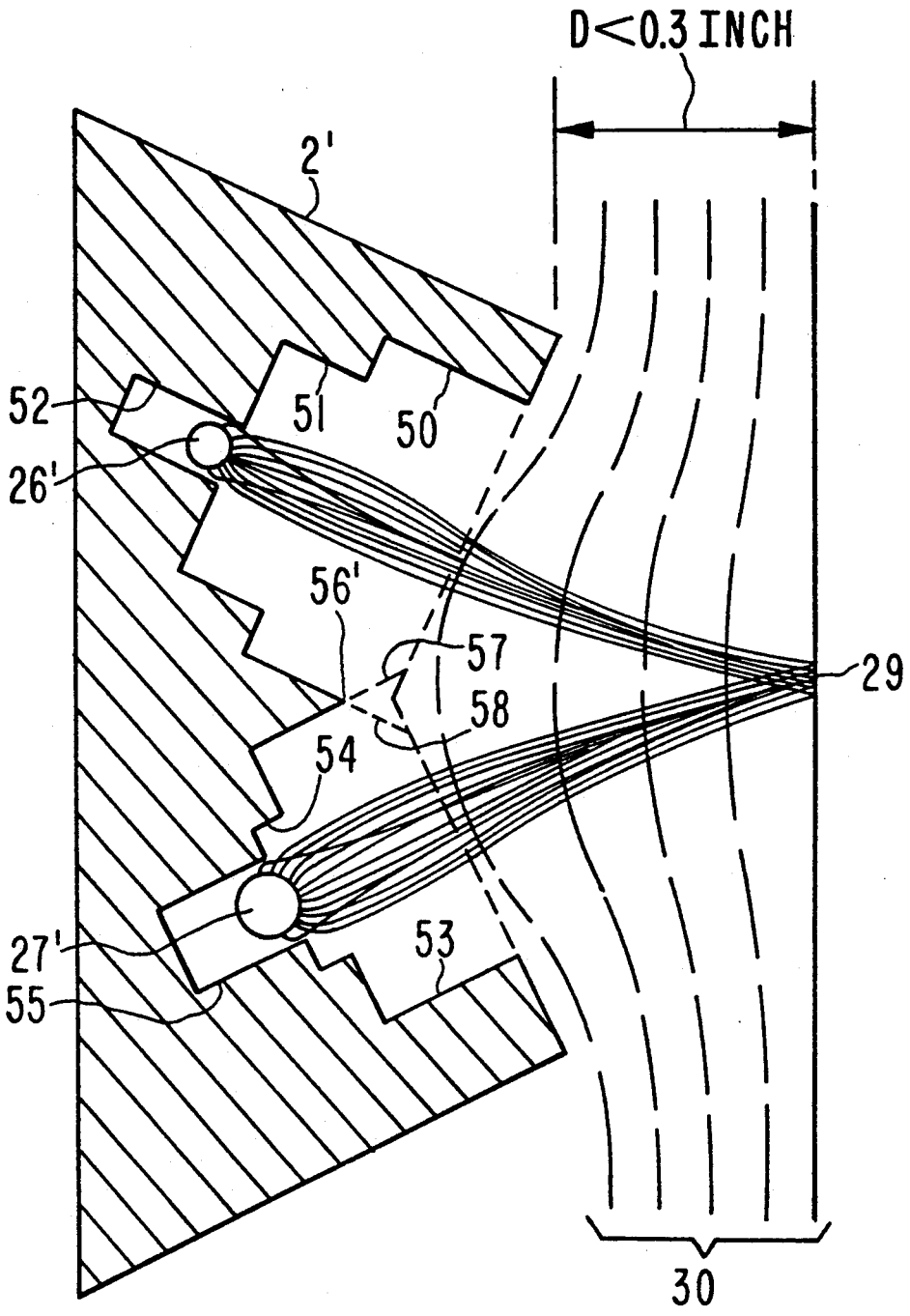
FIG. 5 is a schematic of the electron optics of an embodiment of our invention.

With reference to FIG. 5, an alternate embodiment is illustrated in which a small diameter filament 26' is superimposed in a mammography X-ray tube on the same focii as a larger filament 27'. In FIG. 5, both filament cups are triple slotted configuration. However, the cup slot dimensions in FIG. 5 are not identical as is the configuration of FIG. 3B. Also, the two cups are not equally displaced from the center line. In FIG. 3B, both cups are tipped 25° inward which will not be the case for FIG. 5. The FIG. 5 embodiment is not intended to simultaneously excite the two filaments 26' and 27' but provides the alternate selection capability of the large focii or small focii on the same spot in a mammography X-ray tube.

The invention herein has been described in conjunction with the specific embodiments of the drawings. It is not our intention to limit our invention to any specific embodiment, and the scope of our invention should be determined by our claims.

With this in view, what is claimed is:

1. A mammography X-ray tube comprising:

a vacuum envelope, said vacuum envelope containing, (a) a pair of high voltage insulated terminals, for connecting a high voltage near 27.5 KV±15% from an external voltage generator to the interior of said vacuum envelope;

(b) a plurality of filament current connector terminals for providing external filament current sources to a cathode assembly;

(c) a rotating anode, said rotating anode being connected to one of said high voltage terminals;

(d) said cathode assembly including a cathode cup containing a plurality of filaments, said filaments being 0.3 inches or less displaced from said rotating anode, said cathode cup being connected to the other of said high voltage terminals, so that, in operation, the electric field between said filaments and said rotating anode is on the order of 120 KV/inch, said plurality of filaments being a first pair of filaments connected in parallel to one of said filament current terminals for simultaneous excitation of said first pair of filaments; and (e) said cathode cup further including means for shaping said electric field between said plurality of filaments and said rotating anode so that electron beams produced by said first pair of filaments, in operation, are focused to be superpositioned on a first fixed rectangular region in the space overlying said rotating anode.

2. The X-ray tube of claim 1 wherein said cathode cup further includes a second pair of filaments connected in parallel to a different one of said filament current terminals for simultaneously exciting said second pair of filaments.

3. The X-ray tube of claim 2 wherein said means for shaping said electric field between said second pair of filaments and said rotating anode causes electron beams produced, in operation, to be superpositioned on a second fixed rectangular region in the space overlying said rotating anode.

4. The X-ray tube of claim 2 wherein said cathode assembly comprises a plurality of three slot structures.

5. The X-ray tube of claim 4 wherein said plurality of three slot structures includes a pair of three slot structures in which the largest slot of said pair of three slot structures intersect, such that said largest slot interior sidewall is shorter than the outer sidewall of said largest slot.

6. A mammography X-ray tube having a vacuum envelope, said vacuum envelope comprising:

(a) a cathode structure, said cathode structure having;

(i) a plurality of helical thermal filaments, (ii) a plurality of thermal filament cups, each said thermal filament cup containing at least one of said helical thermal filaments, and having an open top, a closed bottom and a first, second and third coaxial slot, said slots being grooves, said first slot being adjacent to said bottom of said cup, and said second slot being above said first slot, each said first and second slot having a rectangular cross sectional area, each said third slot adjacent to said top of said cup and having a trapezoidal cross sectional area, said cross sectional areas of said slots progressively decreased in the direction from said top to said bottom of said cup, each said third slot having a long side wall and a short side wall, said long side wall and short side wall being parallel, the edge of each said short side wall adjacent said open top being a line of intersection of said short side wall of each said third slot, an angle formed between a pair of said short side walls facing each other being an acute angle;

(b) a rotating anode target, said rotating anode target mounted less than 0.30 inches from said helical thermal filaments.

7. The tube of claim 6 wherein said acute angle is on the order of 40 to 50 degrees.

8. The tube of claim 6 wherein each of said plurality of thermal filament cups contain two thermal filaments.

9. The tube of claim 8 where said two thermal filament are connected at one end to a common electrical terminal and wherein said two thermal filaments are of unequal electron beam producing capacity for the same excitation current.

10. The tube of claim 9 wherein at least one thermal filament in each cup matches the electron beam producing capacity at the same exciting current as a thermal filament in said other cup and wherein each said matching thermal filament is electrically connected in parallel to be simultaneously excited.

11. The tube of claim 10 wherein each thermal filament in each cup has a matching capacity electron beam capacity filament in said intersecting cup and wherein each said matching capacity thermal filament is connected in parallel to its said matching filament for simultaneous excitation therewith.

12. The tube of claim 10 wherein each said cup is configured to cause, in operation, the simultaneously produced electron beams to be superpositioned on the same rectangular region in space in the plane of the face of said rotating anode target.

13. A new method of using a mammography X-ray tube having a rotating anode target and spaced apart cathode, said cathode being a plurality of helically wound filaments, for X-ray mammography comprising the steps of:

simultaneously exiting said plurality of helically wound filaments to each produce a beam of electrons;

shaping the electric field in said space between said rotating anode target and said filaments to simultaneously superposition each said produced electron beam onto the same region on said rotating anode target thereby increasing the intensity of X-rays produced; decreasing the exposure time of a patient such that the integral X-ray intensity times the exposure time is equal to the standard dose.

14. The method of claim 13 wherein said step of simultaneously exciting a plurality of helically wound thermal cathode filaments includes the ability to switch between a first plurality of excited filaments producing a large spot to a second plurality of excited filaments producing a smaller spot, wherein the exposure time of the patient in said smaller spot mode is able to be reduced by a factor five to a time on the order of 1 second while providing the standard X-ray dose.

15. A cathode assembly comprising:

a solid member having a first and second displaced cathode cup therein, each said cathode cup comprising a first, second and third slot cut into said solid member, said first and second slot being parallelepiped shaped and having a rectangular cross section, said third slot being prismoid shaped and having a trapezoidal cross section, each said first, second and third slot of each said cup being coaxial, and sequentially contiguous, each of said slots of said cup being aligned in respect to the other slots of said cup so that there is a plane which is parallel to a longest side of each said slot which is coplanar with and also passes through the center of the cross section of each of said slots of said cup;

said third slot being an outer slot of said cup having the largest cross sectional area, said second slot being an intermediate slot having an intermediate cross sectional area and said first slot being an interior slot having the smallest cross sectional area; and said displaced cups being aligned so that said longest sides of said slots are parallel, and said third slots intersect.

16. An X-ray tube including the cathode assembly of claim 15, said X-ray tube further comprising a vacuum envelope, said vacuum envelope having terminals for high voltage and for cathode excitation current from external energy generators;

rotatable anode target means, said rotatable anode target means being connected to said terminals for said high voltage to establish an intense electric field in the region between said cathode assembly and said rotatable anode, and wherein said smallest slots of said cathode assembly includes an electron generator filament mounted in and insulated from said slot, said filament being connected to said terminals for receiving said cathode excitation current.

* * * * *